US005630335A

United States Patent [19]

Tingvall et al.

[11] Patent Number: 5,630,335

[45] Date of Patent: May 20, 1997

[54] EQUIPMENT-HOLDER BAR FOR A ROLLING MILL STAND

[75] Inventors: Lars G. Tingvall; Lennart Mikael, both of Smedjebacken, Sweden; Gianni Nonino; Ferruccio Tomat, both of Udine, Italy

[73] Assignee: Danieli & C. Officine Meccaniche SpA, Buttrio, Italy

[21] Appl. No.: 411,462

[22] Filed: Mar. 28, 1995

[30] Foreign Application Priority Data

Mar. 31, 1994 [IT] Italy ..... UD94A0050

[51] Int. Cl.[6] ..... B21B 39/16

[52] U.S. Cl. ..... 72/250

[58] Field of Search ..... 72/203, 204, 250, 72/251, 365.2, 366.2, 201

[56] References Cited

U.S. PATENT DOCUMENTS 5,174,142 12/1992 Pong ..... 72/8.6

FOREIGN PATENT DOCUMENTS 2129337 3/1973 Germany .
1351725 5/1974 United Kingdom .

OTHER PUBLICATIONS

Patent Abstracts of Japan vol. 12, No. 182 (M-702) May 27, 1988 & JP-A-62 292 214, Kawasaki Steel Dec. 18, 1987 – Abstract.

Patent Abstracts of Japan vol. 15, No. 493 (M-1191) Dec. 13, 1991 & JP-A-03 216 205 (Kawasaki Steel) Sep. 24, 1991 – Abstract.

Patent Abstracts of Japan, vol. 16 No. 129 (M-1228) Apr. 2, 1992 & JP A-03 291 103 (Kawasaki Steel – Dec. 20, 1991– Abstract.

*Primary Examiner*—Lowell A. Larson
*Assistant Examiner*—Thomas C. Schoeffler
*Attorney, Agent, or Firm*—Antonelli, Terry, Stout & Kraus, LLP

[57] ABSTRACT

Equipment-holder bar (10) associated with a rolling mill stand (11) for the positioning and successive clamping in position of at least a guide box (12) to guide rolled stock in relation to a specific rolling pass defined by rolling rolls (47), the bar (10) comprising a slider (18) able to move lengthwise in both directions on a stationary body (13) solidly fitted to a frame (15) of the rolling mill stand (11), the slider (18) being positioned lengthwise by positioner means (37) consisting of an outer sleeve (21) associated with a rotary positioner shaft (31) set in rotation by a suitable motor, the stationary body (13) and the slider (18) including reciprocal guide means (16–17), the stationary body (13) and the slider (18) comprising lower guide means (**16*a*–17*a*) and downstream inclined guide means (16*b*–17*b*) and also upper movable guide means (38), the stationary body (13) including a lengthwise lodgement seat (22) for the positioner means (37) and a part (45) extending upstream of the seat (22) and containing an inclined surface (39) cooperating with the upper movable guide means (38), the slider (18) including a movable body (40) associated with fork means (19) and with the positioner means (37), the movable body (40) comprising an inclined surface (41) cooperating with the upper movable guide means (38), the upper movable guide means (38) being driven perpendicularly by a hydraulic actuator (35) so as to displace reciprocally and clamp the stationary body (13) and the slider (18**).

6 Claims, 3 Drawing Sheets

EQUIPMENT-HOLDER BAR FOR A ROLLING MILL STAND

BACKGROUND OF THE INVENTION

This invention concerns an equipment-holder bar for a rolling mill stand.

The equipment-holder bar according to the invention is fitted advantageously to rolling mill stands so as to position correctly and to clamp in a desired position the equipment and particularly, but not only, a guide box fitted upstream and possibly also downstream of a rolling mill stand so as to guide the rolled stock.

This equipment-holder bar is installed in cooperation with the specific rolling pass defined by the rolling rolls.

The rolling mill stands of the state of the art entail a series of problems linked to the fact that they have to align and guide the rolled stock being fed so as to ensure the correct rolling of the rolled stock.

In particular, a guide box for the rolled stock is fitted for this purpose upstream of the rolling mill stand and has precisely the task of aligning and guiding the rolled stock immediately upstream of the specific rolling pass defined by the rolling rolls.

These guide boxes for the rolled stock can also be fitted downstream of the rolling mill stand. They entail the problem, however, that they have to be positioned first on the rolling mill stand and thereafter have to be clamped in that position so that they cannot be displaced.

In view of the present high rolling speeds the positioning has to be very accurate; at the present time these guide boxes for the rolled stock are installed on carriages able to run crosswise to the inlet of the rolling mill stand in one direction or the other.

These movable carriages are generally driven by a screw associated with a motor, which is actuated to achieve a millimetric alignment of the rolled stock in relation to the rolling pass.

These positioner carriages include clamping means, which are actuated when the guide box for the rolled stock has been aligned with the rolling pass.

This positioning and clamping system, however, has been found unsatisfactory inasmuch as the carriage undergoes very strong and continuous stresses during the passage of the rolled stock travelling at a high speed even greater than 100 meters per second.

Moreover, the rolled stock being fed, if it is not well aligned, damages the inlet of the guide box.

Furthermore, these stresses entail very strong vibrations and noises which create problems for the apparatus itself and for the surrounding environment.

Besides, owing to the high temperature of the rolled stock being fed, the guide box is cooled continuously with a great flow of water; this cooling water and the scale which becomes detached from the rolled stock passing through are deposited on the screw that adjusts and moves the movable carriage bearing the guide box, thus involving a set of problems due to wear, incorrect functioning, breakages, etc.

So as to obviate these problems, embodiments have been disclosed in which attempts have been made to stiffen the structure of the carriage bearing the guide box for the rolled stock and to reduce the infiltrations of water, scale and other debris into the inside of the carriage by closing the carriage at its upper and lower sides.

SUMMARY OF THE INVENTION

The present applicants have designed, tested and embodied this invention to overcome the shortcomings of the state of the art and to achieve further advantages.

The purpose of this invention is to provide for the rolling mill stand an equipment-holder bar which is at one and the same time simple, safe and efficient and which makes possible an accurate adjustment and secure clamping of the equipment fitted to the bar, such as the guide box for the rolled stock.

The equipment-holder bar according to the invention enables an accurate alignment of the guide box for the rolled stock to be achieved in relation to the specific rolling pass and enables the guide box to be clamped in a stable manner in the right position.

In the equipment-holder bar according to the invention the positioning and clamping assembly is perfectly sealed and thus prevents the water, scale, dust and various debris from being deposited on the adjustment means and from covering those adjustment means with scale, thus avoiding all the problems arising from such infiltrations and/or incrustations.

Moreover, the equipment-holder bar according to the invention has a structure which reduces considerably its overall bulk.

Furthermore, the equipment-holder bar according to the invention comprises a completely automatic clamping and unclamping system, which requires no manual work such as tightening or slackening the clamping nuts or bolts when positioning the guide box correctly.

This clamping system makes the operations of clamping and unclamping the equipment-holder bar and the guide box much more simple and quick without needing any particular effort by the machine operator.

The clamping system according to the invention is also much more efficient and secure than the clamping systems employed heretofore.

The equipment-holder bar according to the invention is clamped to the frame of the rolling mill stand in a known manner such as is able to resist the mechanical and thermal stresses to which the equipment-holder bar is subjected by the passage of the rolled stock being fed.

The equipment-holder bar according to the invention can be installed upstream and possibly also downstream of a rolling mill stand.

Hereinafter we shall refer only to an equipment-holder bar installed upstream and by the terms "upstream" and "downstream" we shall mean positions relative to the direction of feed of the rolled stock.

The equipment-holder bar according to the invention comprises a stationary body extending upstream of, and crosswise to, the rolling mill stand and substantially parallel to the rolling rolls.

This stationary body includes lengthwise guides suitably distributed on its outer surface.

These guides are suitably arranged on different planes so as to enable a slider clamped transversely by these guides to run lengthwise.

The equipment, including the guide box for the rolled stock, to be positioned in relation to the rolling pass and to be clamped thereafter in the right position is associated with the slider.

This slider is associated with lengthwise traversing means comprising an outer sleeve fitted with a seal engagement to an inner sleeve installed in turn with a seal engagement on a rotary positioner shaft.

To be more exact, the rotary positioner shaft is associated with a motor for its rotation in one direction or the other and comprises in a substantially central position a male-threaded segment delimited at both sides by abutments.

A bush including male and female threaded portions cooperates with this male-threaded central segment and is associated in a substantially intermediate position with the inner sleeve, which runs with a seal engagement on the lateral segments of the rotary positioner shaft.

The equipment-holder bar according to the invention includes an outer sleeve installed with a seal engagement on the inner sleeve and including in its inner surface a female-threaded portion with which the male-threaded portion of the bush cooperates.

The equipment-holder slider is associated solidly with this outer sleeve.

The positioning of the equipment in relation to the rolling pass is carried out by rotating the positioner shaft, with a resulting traversing, in one direction or the other, of the threaded bush associated with the outer sleeve, and with a resulting traversing of the outer sleeve.

When the threaded bush abuts against the abutments, the traversing of the inner sleeve on the rotary positioner shaft is blocked.

Further rotation of the rotary positioner shaft therefore sets in rotation also the inner sleeve, while the outer sleeve continues its traversing by cooperation between the male-threaded portion of the bush and the female-threaded portion of the outer sleeve.

It is possible in this way, by merely setting in rotation the positioner shaft, to perform correct alignment of the outer sleeve and therefore of the slider and of the connected equipment such as the guide box for the rolled stock, for instance, in relation to the rolling pass.

The seal engagement between the inner sleeve and the rotary positioner shaft and between the inner sleeve and the outer sleeve prevents possible infiltrations of water, scale, dust or debris which might cause problems in the relative movements of those elements.

The clamping in position of the equipment-holder bar according to the invention is ensured by a hydraulic actuator which, by acting on the slider, creates a transverse pressure on the lengthwise sliding guides, this pressure being such as will prevent any relative movement of the slider on the stationary body.

The subsequent positioning of the slider is therefore carried out by unclamping partly the hydraulic actuator and by rotating the rotary positioner shaft until the slider has been brought to the right position.

In the equipment-holder bar according to the invention the means transmitting the motion from the rotary positioner shaft to the outer sleeve associated with the slider are fully contained within the outer sleeve and are installed with an engagement seal so as to prevent any incrustations due to the cooling water, dust or scale becoming detached from the rolled stock being processed.

Moreover, the equipment-holder bar according to the invention incorporates also means to cool the rolling rolls, these means being positioned between the slider and the relative roll and being solidly fixed to the slider.

The means to cool the rolling rolls are thus protected and these cooling means are shielded from any damage in the event of accidents or of jamming of the rolled stock.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 4:
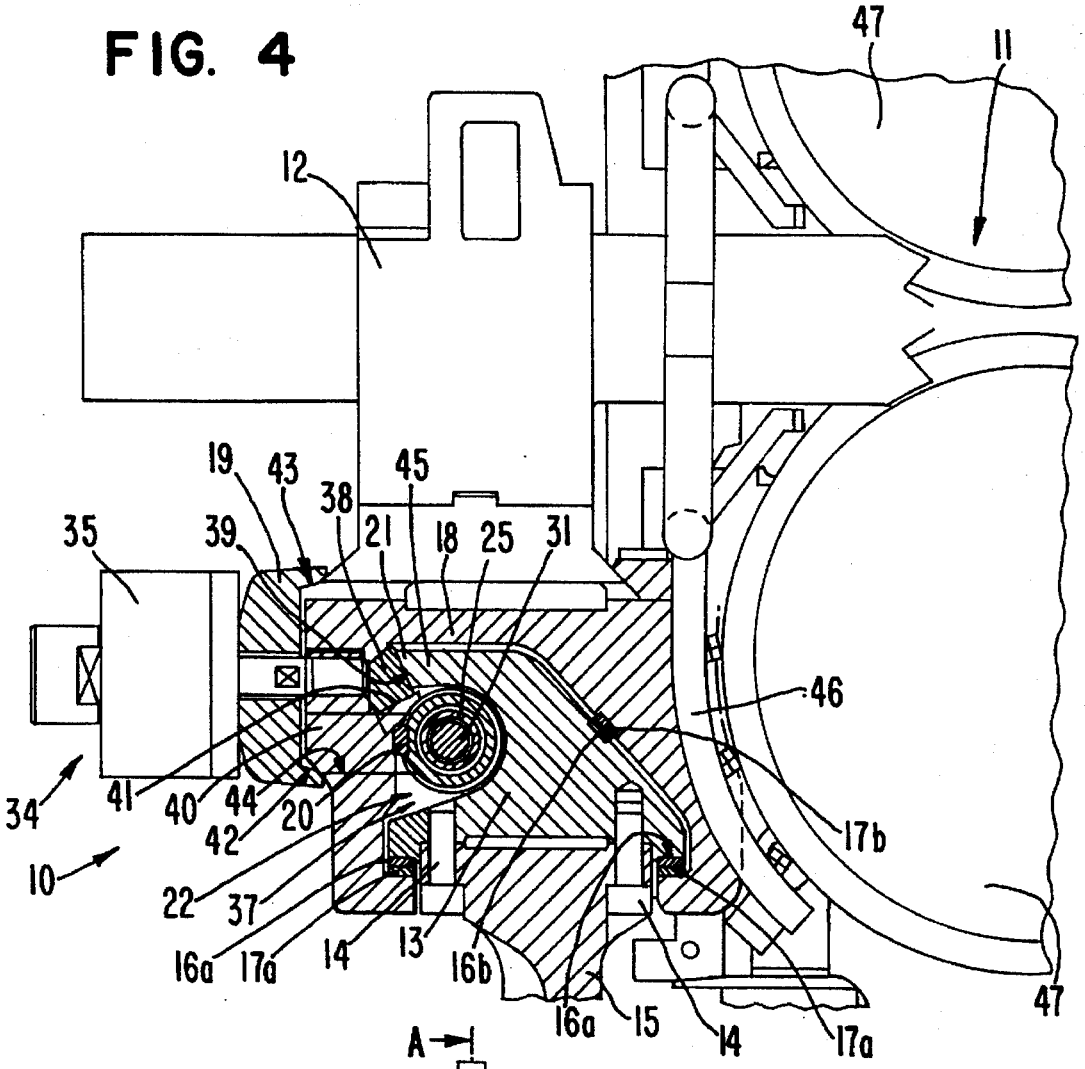
FIG. 4 shows in an enlarged scale the detail "C" of FIG. 2 illustrating the equipment-holder bar according to the invention.
Figure 1:
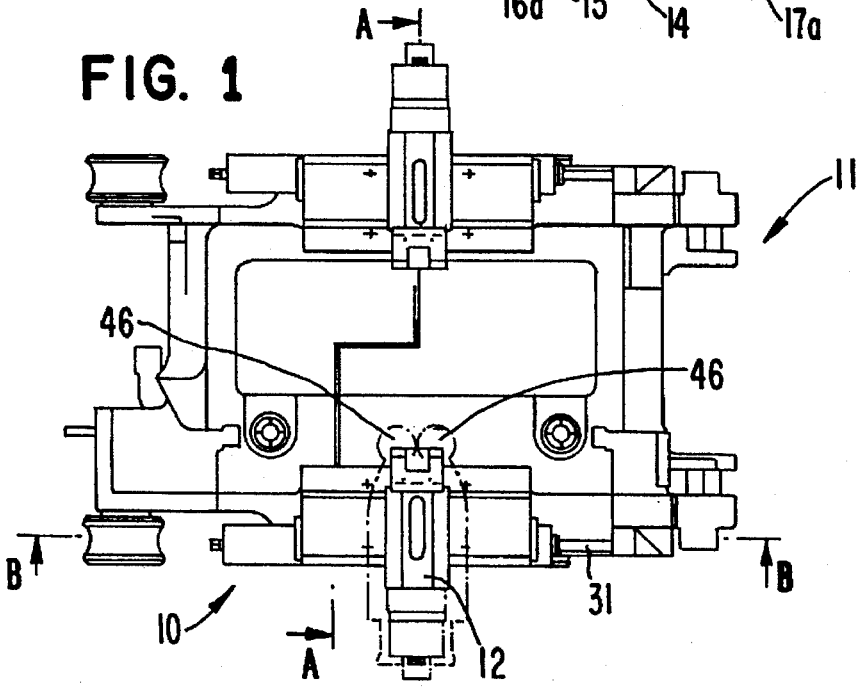
FIG. 1 shows a plan view of an equipment-holder bar according to the invention in association with a rolling mill stand.
Figure 3:
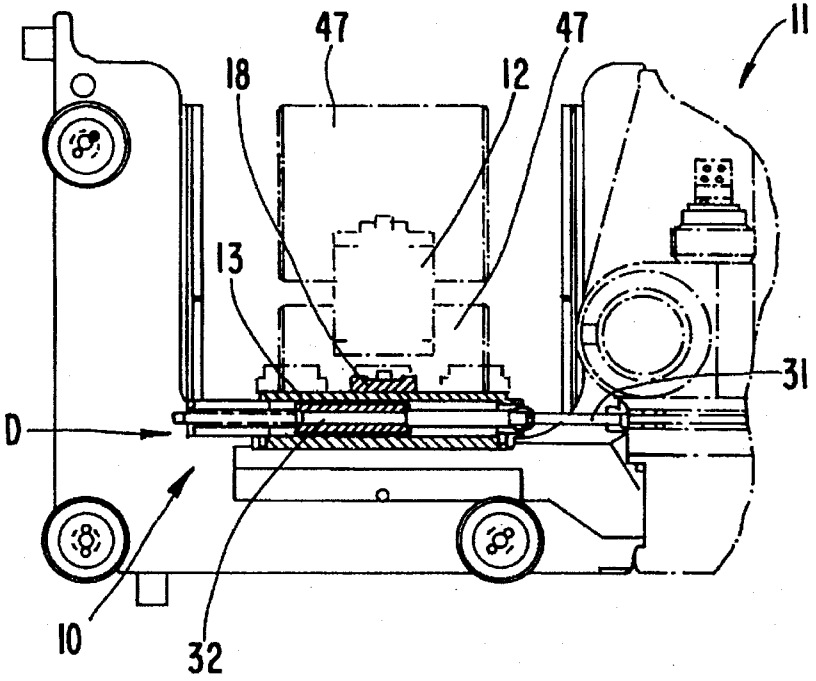
FIG. 3 shows a cross section along the line B—B of the rolling mill stand of FIG. 1 equipped with the equipment-holder bar according to the invention.
Figure 2:
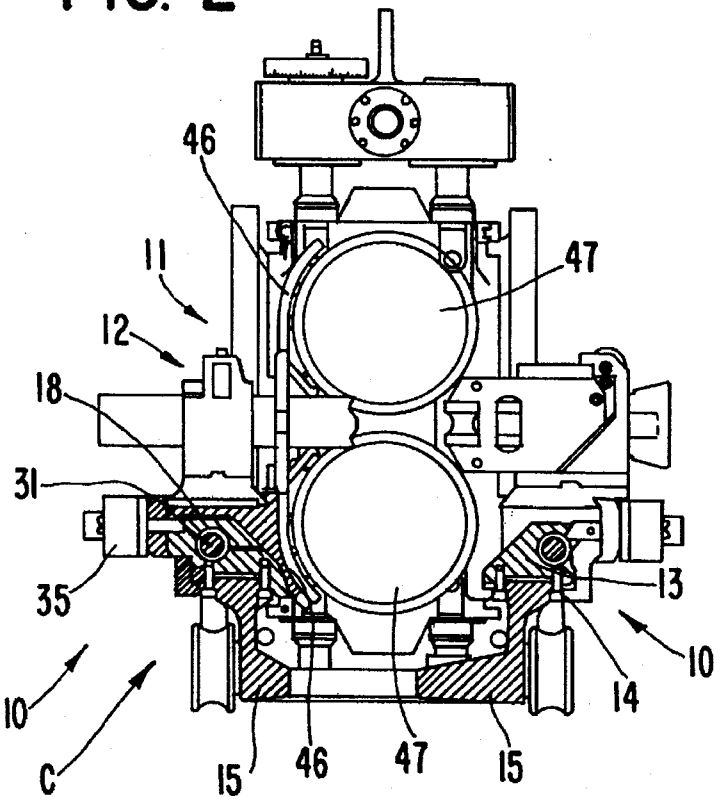
FIG. 2 shows a lengthwise section along the line A—A of the rolling mill stand of FIG. 1 equipped with the equipment-holder bar according to the invention.
Figure 5:
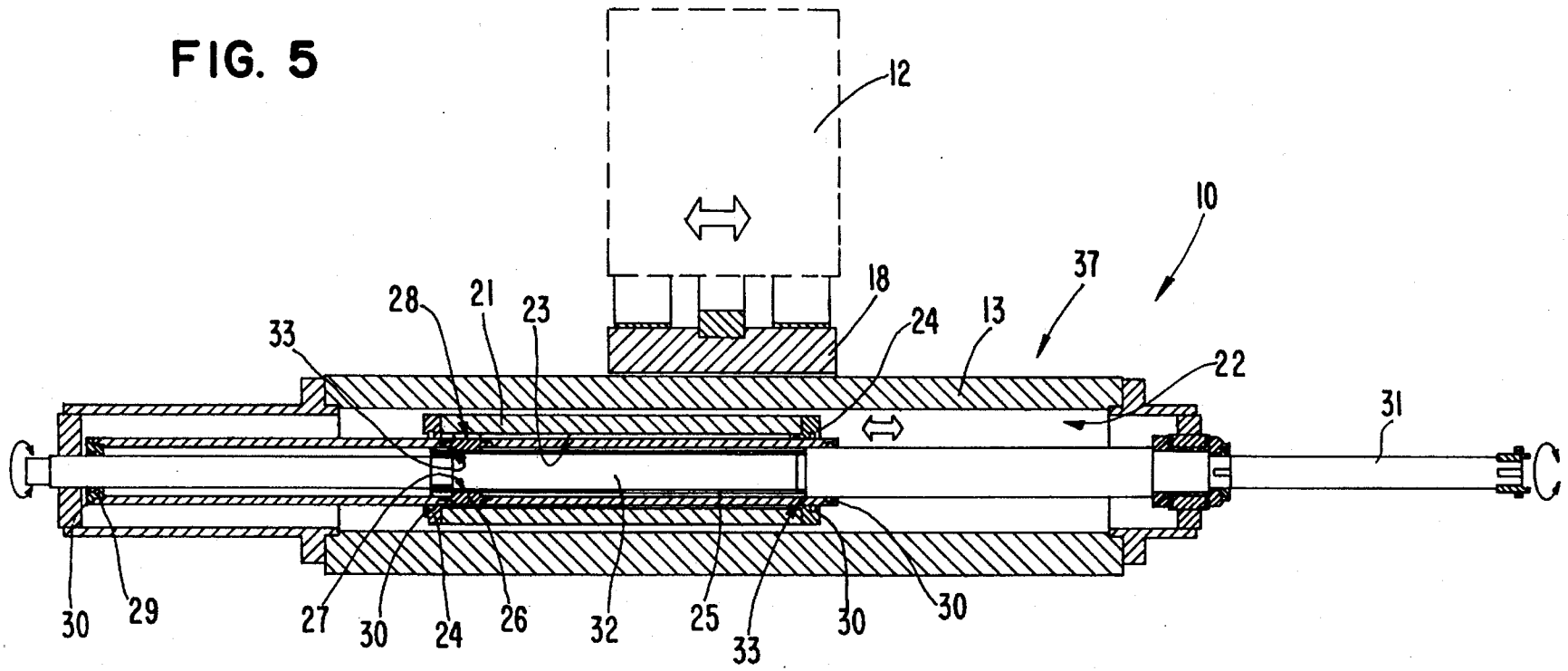
FIG. 5 shows in an enlarged scale the detail "D" of FIG. 3 illustrating the equipment-holder bar according to the invention.

The reference number 10 in the attached figures denotes generally an equipment-holder bar according to the invention.

The equipment-holder bar 10 according to the invention is installed in association with a rolling mill stand 11 for the purpose of positioning and thereafter clamping in position the equipment, such as a guide box 12 for the rolled stock, for instance, in relation to a rolling pass defined by rolling rolls 47.

This equipment-holder bar 10 according to the invention comprises a stationary body 13, which extends crosswise to the rolling mill stand 11 and is secured solidly, in this case, by fixture bolts 14, to a frame 15 of the rolling mill stand 11.

This stationary body 13 includes on its outer surface a plurality of guides 16, which are positioned on different planes and with which there cooperate mating guides 17 included in a coordinated position on a slider 18.

Moreover, the equipment-holder bar 10 according to the invention incorporates also means 46 to cool the rolling rolls 47, these means being positioned between the slider 18 and the relative roll 47 and being solidly fixed to the slider 18.

The means 46 to cool the rolling rolls 47 are thus protected so that they cannot be damaged in the event of accidents or jamming of the rolled stock.

To be more exact, the stationary body 13 and slider 18 include lower guides **16*a*–17*a*, downstream inclined guides 16*b*–17*b* and also upper movable guides 38**.

These guides 16 have the task of guiding and supporting the slider 18 in the traversing movement of the slider 18 crosswise to the rolling mill stand 11.

The slider 18 can slide lengthwise in both directions along the stationary body 13 so as to position transversely the equipment, consisting in this case of the guide box 12, in relation to the rolling pass of the rolling mill stand 11.

The slider 18 is positioned lengthwise by positioner means 37 which include an outer sleeve 21 associated with a rotary positioner shaft 31.

In this example the slider 18 is installed by means of a spline 20 on the outer sleeve 21, which cannot be rotated but can run lengthwise in a seating 22 defined by the stationary body 13 and by the slider 18.

This outer sleeve 21 comprises a female-threaded portion 23 extending along its whole length and cooperates at its two ends with annular stoppers 24 fitted with a seal engagement to an inner sleeve 25; in this case the seal engagement of the annular stoppers 24 on the inner sleeve 25 is obtained with packings 30.

The inner sleeve 25 includes in a substantially central position a bush 26 comprising a female-threaded portion 27 and a male-threaded portion 28.

Moreover, the inner sleeve 25 includes at its ends two annular stoppers 29 installed with a seal engagement obtained with packings 30 on the rotary positioner shaft 31, which is driven by a motor that is not shown here.

The male-threaded portion 28 of the bush 26 cooperates with the female-threaded portion 23 of the outer sleeve 21, whereas the female-threaded portion 27 of the bush 26 cooperates with the intermediate threaded segment 32 of the rotary positioner shaft 31; this intermediate threaded segment 32 is delimited at both its ends by abutments 33.

In this case, for the purpose of merely facilitating the constructional embodiment, the inner sleeve 25 has been embodied with two segments, which are connected solidly at one side and the other to the bush 26.

A part 45 of the stationary body 13 extending upstream of the lodgement seat 22 includes an inclined surface 39 cooperating with the upper movable guides 38.

The slider 18 includes a movable body 40 associated with fork means 19 and with the positioner means 37; this movable body 40 has an inclined surface 41 cooperating with the upper movable guides 38, which are actuated perpendicularly by clamping/unclamping means 34 comprising a hydraulic actuator 35 so as to displace reciprocally and to clamp the stationary body 13 and the slider 18.

The movable body 40 is conformed advantageously substantially as a cylinder and can be rotated circumferentially and be moved axially in a seating 44 included in the slider 18.

The clamping in position of the slider 18 and therefore of the guide box 12 for the rolled stock is achieved by actuating the clamping/unclamping means 34 comprising the hydraulic actuator 35.

The hydraulic actuator 35 acts on the fork means 19 associated with the stationary body 13 and cooperating with the slider 18.

The actuation of the hydraulic actuator 35 causes the slider 18 to act with a desired pressure on the guides 16 of the frame 15 and thus clamps the slider 18 in position.

In this case the fork means 19 associated with the hydraulic actuator 35 cooperate on one side with an inclined surface 42 included on the slider 18 and on the other side with an inclined surface 43 on the guide box 12 for the rolled stock.

We claim:

1. Equipment-holder bar associated with a rolling mill stand for the positioning and successive clamping in position of at least a guide box to guide rolled stock in relation to a specific rolling pass defined by rolling rolls, the bar comprising a slider able to move lengthwise in both directions on a stationary body solidly fitted to a frame of the rolling mill stand, the slider being positioned lengthwise by positioner means comprising an outer sleeve associated with a rotary positioner shaft set in rotation by a motor, the stationary body and the slider including reciprocal, lower guide means, and downstream inclined guide means and upper movable guide means, the stationary body including a lengthwise lodgement seat for the positioner means and a part extending upstream of the seat and containing an inclined surface cooperating with the upper movable guide means, the slider including a movable body associated with fork means and with the positioner means, the movable body comprising an inclined surface cooperating with the upper movable guide means, the upper movable guide means being driven perpendicularly by a hydraulic actuator so as to displace reciprocally and clamp the stationary body and the slider.

2. Equipment-holder bar as in claim 1, in which the fork means are associated with the hydraulic actuator and cooperate on one side with an inclined surface included on the slider and on the other side with an inclined surface included on a guide box.

3. Equipment-holder bar as in claim 1, in which the movable body has a substantially cylindrical conformation and can be rotated circumferentially and be moved axially in a seating included in the slider.

4. Equipment-holder bar as in claim 1, in which the outer sleeve is associated with the slider through the movable body and in which an inner sleeve is further provided such that the outer sleeve is able to slide on the inner sleeve with a seal engagement.

5. Equipment-holder bar as in claim 4, in which the inner sleeve includes in a substantially central position a bush, which comprises a male-threaded portion cooperating with a female-threaded portion of the outer sleeve and also comprises a female-threaded portion cooperating with an intermediate male-threaded segment of the rotary positioner shaft, the intermediate male-threaded segment of the rotary positioner shaft being delimited at its sides by abutments.

6. Equipment-holder bar as in claim 1, which incorporates means to cool rolls, these means being positioned between the slider and the relative roll and being solidly fixed to the slider.

* * * * *